US008350659B2

(12) United States Patent
Dziubek et al.

(10) Patent No.: US 8,350,659 B2
(45) Date of Patent: Jan. 8, 2013

(54) TRANSFORMER WITH CONCENTRIC WINDINGS AND METHOD OF MANUFACTURE OF SAME

(75) Inventors: Christopher Dziubek, Seattle, WA (US); David Perchlik, Redmond, WA (US); Jay Kuehny, Sammamish, WA (US)

(73) Assignee: Crane Electronics, Inc., Redmond, WA (US)

( * ) Notice: Subject to any disclaimer, the term of this patent is extended or adjusted under 35 U.S.C. 154(b) by 402 days.

(21) Appl. No.: 12/580,551

(22) Filed: Oct. 16, 2009

(65) Prior Publication Data

US 2011/0090039 A1 Apr. 21, 2011

(51) Int. Cl.
*H01F 27/28* (2006.01)
*H01F 27/30* (2006.01)

(52) U.S. Cl. ..... 336/220; 336/205; 336/206; 336/222; 336/223

(58) Field of Classification Search ..... 336/205, 336/206, 220, 222, 223
See application file for complete search history.

(56) References Cited

U.S. PATENT DOCUMENTS

| | | | | |
|---|---|---|---|---|
| 2,378,884 | A | 6/1945 | Seifert | 175/356 |
| 2,474,395 | A | 6/1949 | Early et al. | 175/356 |
| 2,497,516 | A | 2/1950 | Phelps | 175/356 |
| 2,571,418 | A | 10/1951 | Castenschiold | 175/362 |
| 4,813,126 | A | 3/1989 | Williamson | 29/729 |
| 4,814,735 | A | 3/1989 | Williamson | 336/192 |
| 4,833,437 | A | 5/1989 | Williamson | 336/192 |
| 4,901,048 | A | 2/1990 | Williamson | 336/180 |
| 6,734,775 | B2 | 5/2004 | Chung | 336/198 |
| 6,781,498 | B2 | 8/2004 | König | 336/180 |
| 6,970,063 | B1 | 11/2005 | Fromm et al. | 336/182 |
| 7,046,492 | B2 * | 5/2006 | Fromm et al. | 361/38 |
| 7,318,270 | B1 | 1/2008 | O'Loughlin | 29/605 |
| 2002/0011914 | A1 | 1/2002 | Ikeura et al. | 336/208 |
| 2008/0150670 | A1 * | 6/2008 | Chung et al. | 336/84 C |
| 2008/0174396 | A1 | 7/2008 | Choi et al. | 336/182 |

(Continued)

FOREIGN PATENT DOCUMENTS

| | | |
|---|---|---|
| GB | 1114013 | 5/1968 |

(Continued)

OTHER PUBLICATIONS

Perchlik, "Transformer Having Interleaved Windings and Method of Manufacture of Same," U.S. Appl. No. 12/580,548, filed Oct. 16, 2009, 25 pages.

(Continued)

*Primary Examiner* — Mohamad Musleh
*Assistant Examiner* — Ronald Hinson
(74) *Attorney, Agent, or Firm* — Seed IP Law Group PLLC

(57) ABSTRACT

A transformer may include a first and a second continuous single piece multi-turn helical winding, one concentrically received by the other. The turns of the windings are electrically insulated from one another and spaced sufficiently close together to permit inductive coupling therebetween. The turns may be formed of a conductor having a rectangular cross-section, which may, or may not, include an electrically insulative sheath. The single piece multi-turn helical windings may have a continuous or smooth radius of curvature, with no discontinuities or singularities between first and second end terminals. The transformer may be formed by wrapping electrical conductor about a winding form. The transformer may be used in various electrical circuits, for example converter circuits.

14 Claims, 5 Drawing Sheets

U.S. PATENT DOCUMENTS

2008/0186121 A1 8/2008 Kawahata et al.

FOREIGN PATENT DOCUMENTS

| | | |
|---|---|---|
| JP | 8-78252 | 3/1996 |
| JP | 2567069 | 12/1996 |

OTHER PUBLICATIONS

International Search Report, mailed Jun. 8, 2011, for PCT/US2010/052705, 5 pages.

Written Opinion, mailed Jun. 8, 2011, for PCT/US2010/052705, 4 pages.

International Search Report, mailed Jun. 8, 2011, for PCT/US2010/052707, 5 pages.

Written Opinion, mailed Jun. 8, 2011, for PCT/US2010/052707, 3 pages.

Perchlik, "Transformer Having Interleaved Windings and Method of Manufacture of Same," Office Action for U.S. Appl. No. 12/580,548, mailed Jul. 18, 2012, 9 pages.

* cited by examiner

TRANSFORMER WITH CONCENTRIC WINDINGS AND METHOD OF MANUFACTURE OF SAME

BACKGROUND

1. Field

This disclosure generally relates to transformers having primary and secondary windings.

2. Description of the Related Art

Transformers are useful for stepping up or stepping down a voltage and/or for electrically isolating two portions of a circuit.

A transformer typically includes at least two windings of electrically conductive material such as wire. The windings are electrically isolated from one another but spaced sufficient close together such that an electrical current flow through one winding will induce an electrical current to flow in the other winding. The winding through which the current is driven is typically denominated as the primary winding, while the winding in which the current is induced is typically denominated as the secondary winding. The transformer may also include a core, for example a magnetic or ferrous core extending between the windings.

A large variety of transformers of various designs are currently commercially available. Numerous transformers of other designs have been available in the past. Numerous other transformer designs have been proposed.

In many applications, transformer size and/or weight are important factors in realizing a practical and/or commercially successful device. For example, transformers for use in avionics typically must be lightweight and may need to occupy a small volume. Such applications, however, typically require high performance. Performance may be dictated by a number of factors; for example, the amount of conductive material in the windings, the surface area of the windings, and/or the proximity of the windings to one another. Many applications may additionally, or alternatively, require low-cost transformers. Cost may be dictated by a number of factors including type of materials, amount of materials, and/or complexity of manufacture, among other factors.

New transformer designs and methods of manufacture of transformers are desirable to address at least some of the disparate needs of various technical applications that employ transformers.

BRIEF SUMMARY

A transformer may be summarized as including a first continuous single piece multi-turn helical winding having at least a first terminal and a second terminal; and a second continuous single piece multi-turn helical winding having at least a first terminal and a second terminal, a portion of the second continuous single piece multi-turn helical winding between the first and the second terminals received concentrically within an inner diameter of the first continuous single piece multi-turn helical winding, the portion of the second continuous single piece multi-turn helical winding spaced sufficiently closely to the first continuous single piece multi-turn helical winding to permit inductive coupling therebetween in response to a current running through at least one of the first or the second continuous single piece multi-turn helical windings, wherein at least one of the first or the second continuous single piece multi-turn helical winding consists of an electrical conductor and an electrically insulative sheath that electrically insulates the electrical conductor between first and the second terminals thereof from the other one of the first or the second continuous single piece multi-turn helical windings.

The electrical conductor of the at least one of the first or the second continuous single piece multi-turn helical windings may have a rectangular cross-section taken perpendicular to a longitudinal axis of the first or the second continuous single piece multi-turn helical windings at a point along the longitudinal axis. Both of the first and the second continuous single piece multi-turn helical windings may consist of an electrical conductor and an electrically insulative sheath that electrically insulates the electrical conductor between the first and the second terminals thereof. The first and the second continuous single piece multi-turn helical windings may each have a smooth radius of curvature with no discontinuities between the first terminal and the second terminal as projected on an X-Y plane that is perpendicular to a respective longitudinal axis of the first and the second continuous single piece multi-turn helical windings. At least one of the first or the second continuous single piece multi-turn helical windings may be cylindrical having a circular cross-section taken along a longitudinal axis of the first or the second continuous single piece multi-turn helical winding. The first continuous single piece multi-turn helical winding may have only two terminals, each of the first and the second terminals thereof extending from a respective end of the first continuous single piece multi-turn helical winding and wherein the second continuous single piece multi-turn helical winding may have only two terminals, each of the first and the second terminals thereof extending from a respective end of the second continuous single piece multi-turn helical winding. The transformer may further include at least a portion of a core received within an inner diameter of at least one of the first or the second continuous single piece multi-turn helical windings. The transformer may further include at least a portion of a ferrous core received within an inner diameter of at least one of the first or the second continuous single piece multi-turn helical windings. The first continuous single piece multi-turn helical winding may have more turns than the second continuous single piece multi-turn helical winding. The first continuous single piece multi-turn helical winding may have less turns than the second continuous single piece multi-turn helical winding.

A method of forming a transformer may be summarized as including forming a first continuous single piece multi-turn helical winding consisting of a first electrical conductor and an electrically insulative sheath in which the first electrical conductor is received; and forming a second continuous single piece multi-turn helical winding comprising a second electrical conductor; and concentrically locating one of the first or the second continuous single piece multi-turn helical winding in an inner diameter of the other one of the first or the second continuous single piece multi-turn helical winding, at least portions of the first and the second continuous single piece multi-turn helical winding spaced sufficiently closely to one another to cause inductive coupling therebetween in response to a current passing through at least one of the first or the second continuous single piece multi-turn helical windings.

Concentrically locating one of the first or the second continuous single piece multi-turn helical winding in an inner diameter of the other one of the first or the second continuous single piece multi-turn helical winding may include concentrically locating the first continuous single piece multi-turn helical winding in the inner diameter of the second continuous single piece multi-turn helical winding. Concentrically locating one of the first or the second continuous single piece multi-turn helical winding in an inner diameter of the other one of the first or the second continuous single piece multi-turn helical winding may include concentrically locating the second continuous single piece multi-turn helical winding in the inner diameter of the first continuous single piece multi-turn helical winding. Forming a second continuous single piece multi-turn helical winding may include a second electrical conductor includes forming the second continuous single piece multi-turn helical winding consisting of the second electrical conductor and an electrically insulative sheath in which the second electrical conductor is received. Forming a first continuous single piece multi-turn helical winding consisting of a first electrical conductor and an electrically insulative sheath in which the first electrical conductor is received may include wrapping the electrically insulative sheath and the first electrical conductor about a winding form to form the first continuous single piece multi-turn helical winding with a smooth radius of curvature having no discontinuities between a first terminal and a second terminal thereof. Forming a second continuous single piece multi-turn helical winding comprising a second electrical conductor may include wrapping the second electrical conductor about a winding form to form the second continuous single piece multi-turn helical winding with a smooth radius of curvature having no discontinuities between a first terminal and a second terminal thereof.

A power converter may be summarized as including a first continuous single piece multi-turn helical winding having at least a first terminal and a second terminal; a second continuous single piece multi-turn helical winding having at least a first terminal and a second terminal, a portion of the second continuous single piece multi-turn helical winding between the first and the second terminals received concentrically within an inner diameter of the first continuous single piece multi-turn helical winding, the portion of the second continuous single piece multi-turn helical winding spaced sufficiently closely to the first continuous single piece multi-turn helical winding to permit inductive coupling therebetween in response to a current running through at least one of the first or the second continuous single piece multi-turn helical windings, wherein at least one of the first or the second continuous single piece multi-turn helical winding consists of an electrical conductor and an electrically insulative sheath that electrically insulates the electrical conductor between first and the second terminals thereof from the other one of the first or the second continuous single piece multi-turn helical windings; and at least one switch operable to interrupt a flow of current through one of the first or the second continuous single piece multi-turn helical windings.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with transformers, circuits employing transformers, and machinery useful in manufacturing transformers have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Further more, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the embodiments.

Figure 1:
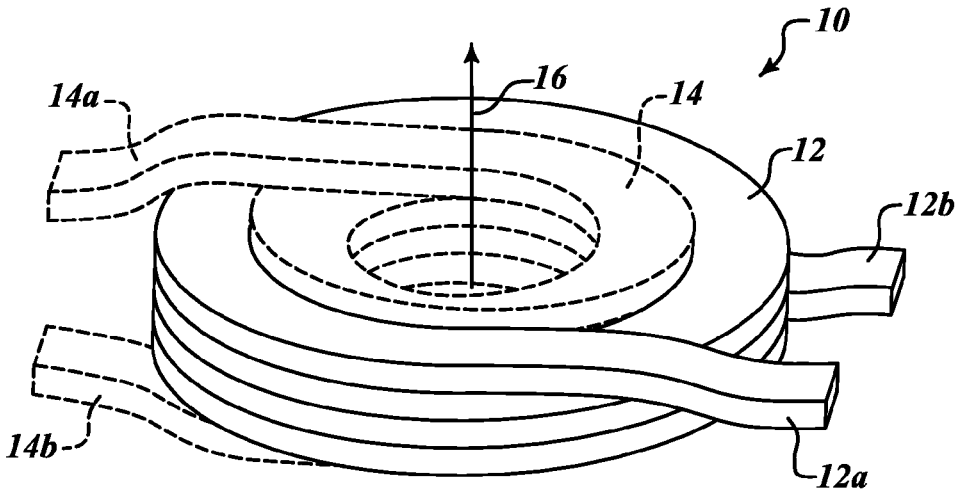
FIG. 1 is a front top isometric view of a transformer having first and second continuous single piece multi-turn helical windings, one received concentrically within the other, according to one illustrated embodiment.
Figure 2:
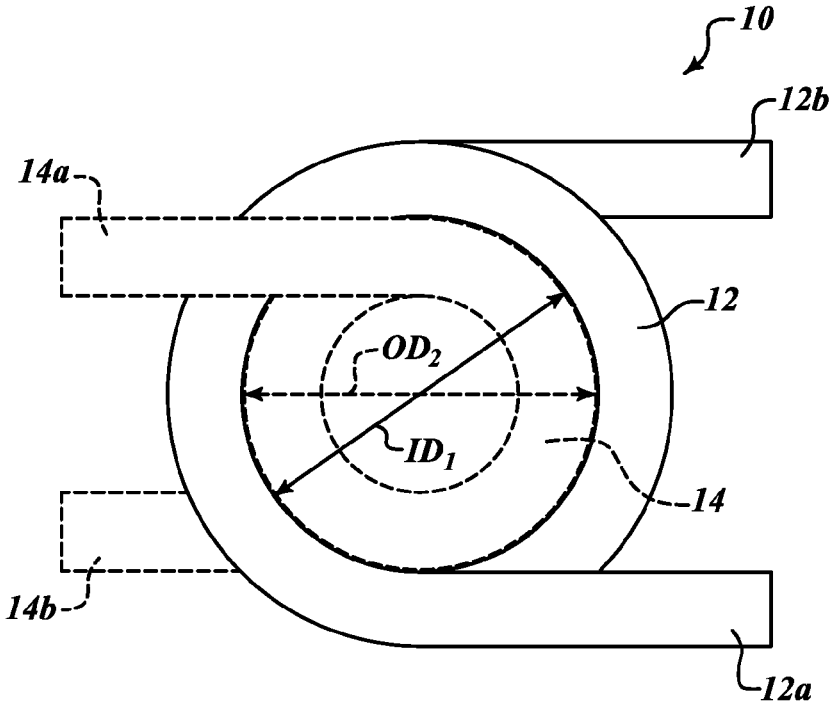
FIG. 2 is a top plan view of the transformer of FIG. 1.
Figure 3:
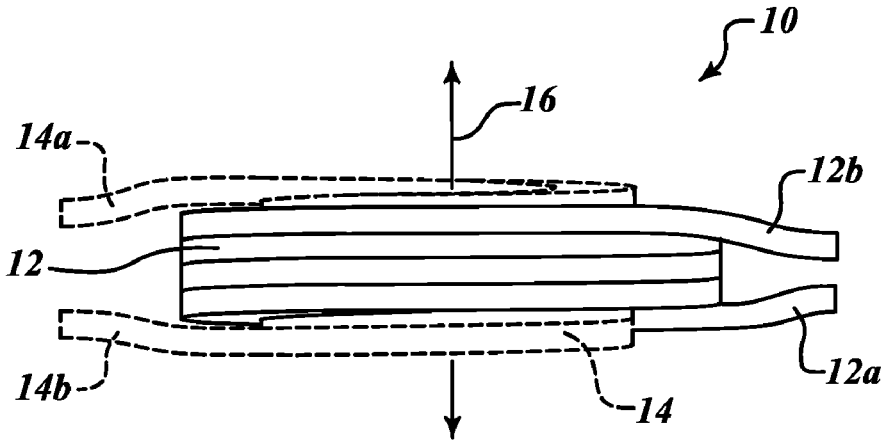
FIG. 3 is a front elevational view of the transformer of FIG. 1.

FIGS. 1-3 show a transformer 10 according to one illustrated embodiment.

The transformer 10 includes a first continuous single piece multi-turn electrical winding 12 and a second continuous single piece multi-turn helical winding 14. The second continuous single piece multi-turn helical winding 14 is electrically insulated from the first continuous single piece multi-turn helical winding 12. The turns of the second continuous single piece multi-turn helical winding 14 are concentrically received within the turns of the first continuous single piece multi-turn helical winding 12, co-axially aligned along a longitudinal axis 16. The turns of the first and second continuous single piece multi-turn helical windings 12, 14 are spaced closely enough together to provide inductive coupling therebetween. Hence, an outer diameter $OD_2$ (FIG. 2) of the second continuous single piece multi-turn helical winding 14 is closely received by an inner diameter $ID_1$ (FIG. 2) of the first continuous single piece multi-turn helical winding 12.

Figure 5:
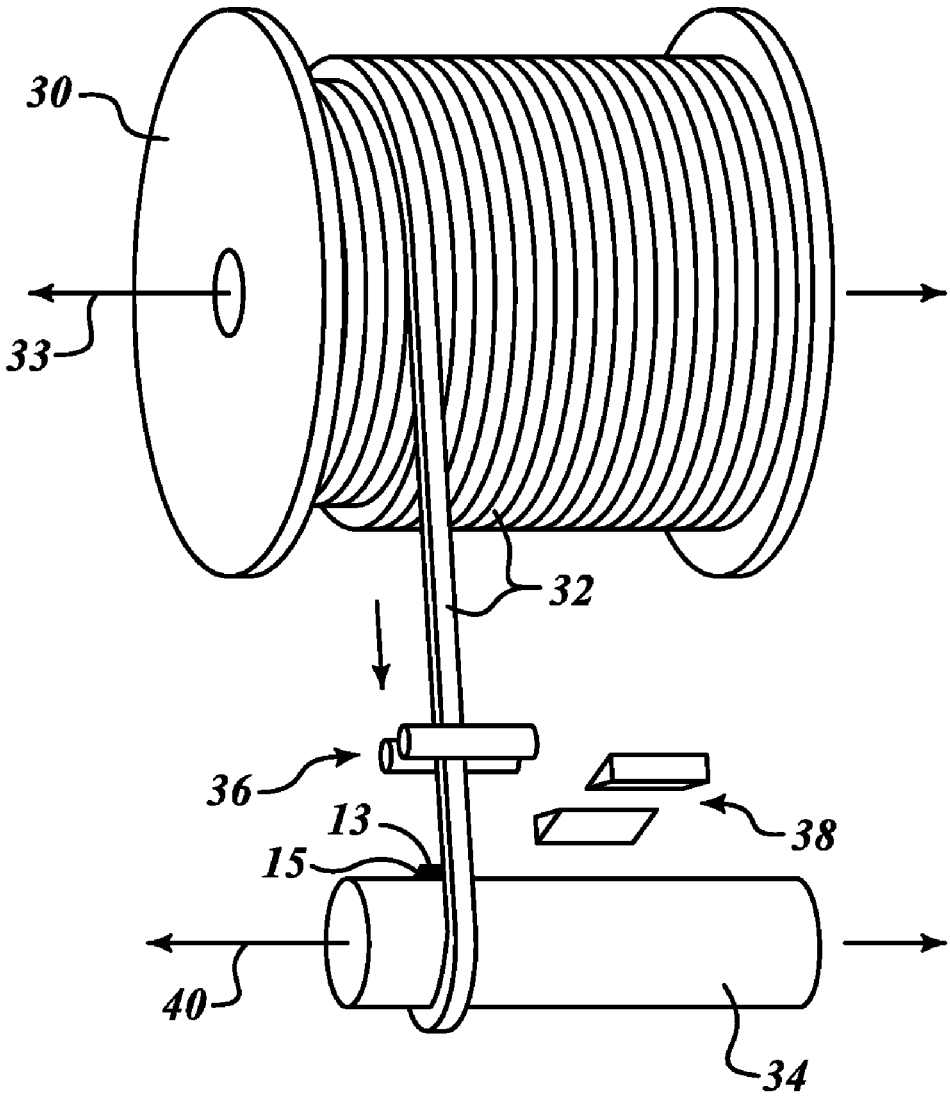
FIG. 5 is an isometric view showing a continuous single piece multi-turn helical winding being wrapped around a winding form or mandrel to form a number of turns, according to one illustrated embodiment.

At least one of the first and/or the second continuous single piece multi-turn helical windings 12, 14 may be formed of a conductor such as a wire 13 (FIG. 5). The wire 13 may advantageously have a rectangular cross section. The rectangular cross section may advantageously be relatively thick (i.e., thicker than either a heavy gauge foil or printed trace of conductive material). At least one of the first and/or the second continuous single piece multi-turn helical windings 12, 14 may have an electrically insulative sheath 15 (FIG. 5) that at least partially surrounds the electrical conductor over at least some portion of a length of the first and/or second continuous single piece multi-turn helical windings 12, 14. In some embodiments, only one of the first or the second continuous single piece multi-turn helical windings 12, 14 carries the electrically insulative sheath, providing electrical insulation between that electrical conductor and the electrical conductor forming the other one of the continuous single piece multi-turn helical windings 12, 14. The electrically insulative sheet can be formed of any of a large variety of electrically insulative materials, for example various electrically insulative polymers (e.g., PTFE or TEFLON®, PVC, KAPTON®, rubber, polyethylene, or polypropylene).

As illustrated in FIGS. 1-3, the first and the second continuous single piece multi-turn helical windings 12, 14 may be cylindrical, having a circular cross section. Other embodiments may employ other geometrical shapes, for example conic sections such as a cone, frusto-conical or hyperbola.

Being wound instead of folded, the first and/or second continuous single piece multi-turn helical windings 12, 14 may have a continuous or smooth radius of curvature when an outer diameter $OD_1$, $OD_2$ is projected on an X-Y plane (not shown) that is perpendicular to a longitudinal axis 16 (FIGS. 1, 3). In particular, the radius of curvature of the first and second continuous single piece multi-turn helical windings 12, 14 may have no discontinuities or singularities between a first terminal 12*a*, 14*a*, respectively, and a second terminal 12*b*, 14*b*, respectively.

The first and second continuous single piece multi-turn helical windings 12, 14 may have only two terminals, one at each, 12*a*, 12*b*, 14*a*, 14*b*. The terminals 12*a*, 12*b*, 14*a*, 14*b* extend from respective ends of the first and second continuous single piece multi-turn helical windings 12, 14. The terminals 12*a*, 12*b*, 14*a*, 14*b* allow electrical connections to be made to respective circuits or portions of a circuit. Thus the transformer 10 may be easily integrated into various circuits.

A ratio of turns of the first continuous single piece multi-turn helical winding 12 to turns of the second continuous single piece multi-turn helical winding 14 may, for example, be equal to or close to 1:1. The ratio of turns of the first continuous single piece multi-turn helical winding 12 to turns of the second continuous single piece multi-turn helical winding 14 may be greater than 1:1, for example 2:1, 3:1, 4:1 or more. The ratio of turns of the first continuous single piece multi-turn helical winding 12 to turns of the second continuous single piece multi-turn helical winding 14 may less than 1:1, for example 1:2, 1:3, 1:4 or less. Transformers may employ any other ratios of turns than those ratios generally described above.

Figure 4:
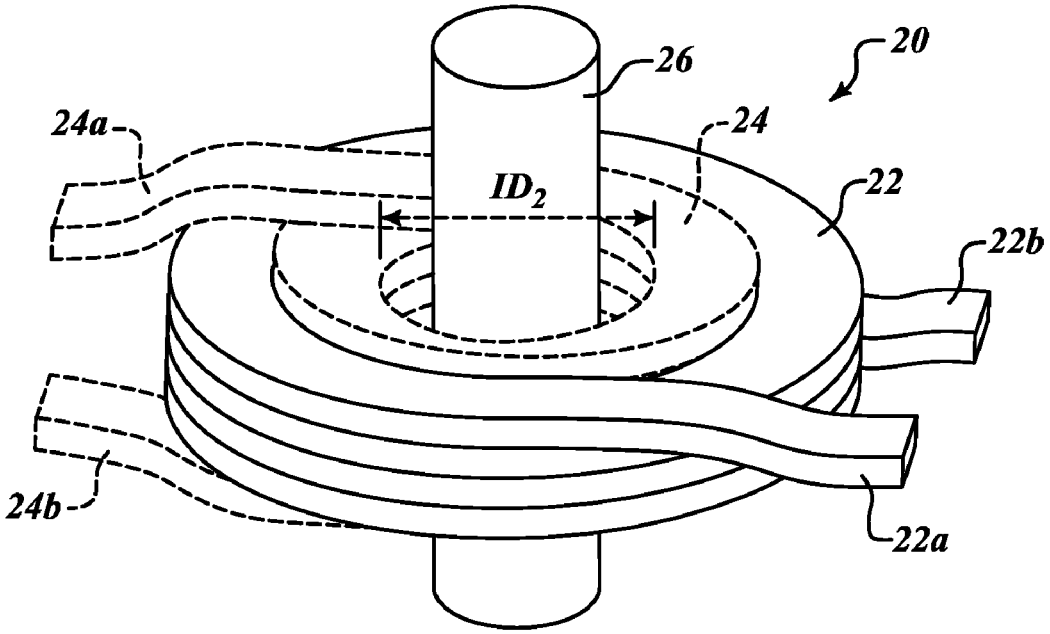
FIG. 4 is a front top isometric view of a transformer in which a core is received by the first and second continuous single piece multi-turn helical windings, according to another illustrated embodiment.

FIG. 4 shows a transformer 20 according to another illustrated embodiment.

The transformer 20 includes a first continuous single piece multi-turn helical winding 22, and a second continuous single piece multi-turn helical winding 24 concentrically received within an inner diameter $ID_1$ of the first continuous single piece multi-turn helical winding 22. The first and the second continuous single piece multi-turn helical windings 22, 24 each have respective terminals 22*a*, 22*b*, 24*a*, 24*b* located at the ends thereof.

The transformer 20 also includes a core 26 received through a passage formed by the inner diameters $ID_2$ of the second continuous single piece multi-turn helical windings 24. The core 26 may, for example, take the form of a magnetizable or ferrite material, for instance a rod or bar of ferrite, samarium cobalt or neodymium-iron-boron.

While not illustrated, the transformer 20 may include a housing. The housing may include one or more parts, for example a first portion and a second portion. The first portion may include an end cover and a core, for example magnetizable or ferrite core. The core may be formed as a separate individual piece from the first and second parts. Alternatively, the core may be formed integrally as a single piece with either the first portion or second portion. Alternatively, a respective portion of the core may be formed integrally with the first portion or second portion. The first portion and second portions may selectively securely attach to one another. Employing two or more portions advantageously allows a multi-piece housing to be installed after the first and second continuous single piece multi-turn helical windings are concentrically mounted, one within the other.

FIG. 5 shows a method of forming a transformer according to one illustrated embodiment.

A supply reel 30 supplies an electrical conductor 32 to a winding form or mandrel 34. The supply reel 30 may rotate about a longitudinal axis 33 of the supply reel. The electrical conductor 32 is wrapped about the winding form or mandrel 34 to form a continuous single piece multi-turn helical winding. While the winding form or mandrel 34 is illustrated as having a cylindrical shape with a circular cross-section, other shapes may be employed to achieve continuous single piece multi-turn helical windings of other configurations.

The electrical conductor 32 may pass through one or more rollers or pairs of rollers 36 while advancing toward the winding form or mandrel 34. Such may be used to shape the electrical conductor 32, for example to facilitate the formation of the smooth radius of curvature for the turns of the continuous single piece multi-turn helical winding. Additionally or alternatively, electrical conductor 32 may pass through one or more cutters 38 to separate the continuous single piece multi-turn helical winding from the supply reel 30.

In some embodiments, the winding form or mandrel 34 may be kept fixed while the electrical conductor 32 and/or supply reel 30 is rotated thereabout. In other embodiments, the winding form or mandrel 34 may rotate about a longitudinal axis 40 while the supply reel 30 rotates about respective axis 33 to supply the electrical conductor 32 to the winding form or mandrel 34. In other embodiments, the supply reel 30 may additionally, or alternatively, rotate about the longitudinal axis 40 of the winding form or mandrel 34.

Figure 6:
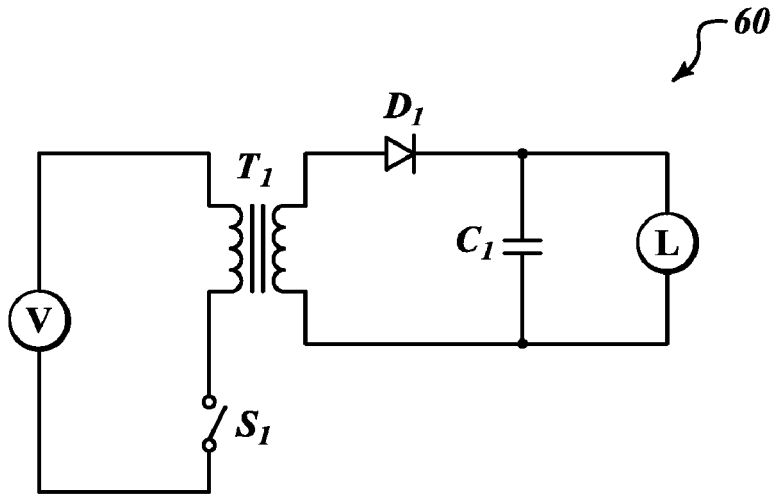
FIG. 6 is an electrical schematic diagram of a flyback converter circuit employing a transformer having concentric first and second continuous single piece multi-turn helical windings, according to one illustrated embodiment.

FIG. 6 shows a flyback converter 60 that employs a transformer $T_1$ having concentrically arranged continuous single piece multi-turn helical windings, according to another illustrated embodiment.

The flyback converter 60 may electrically couple a power source V to a load L via the transformer $T_1$. A switch $S_1$ alternating electrically couples and decouples the power source V to a primary winding of the transformer $T_1$ to produce a changing current therethrough. The changing current passing through the primary winding of the transformer $T_1$ induces a current in a secondary winding of the transformer $T_1$.

The secondary winding is electrically coupled to the load L via a diode $D_1$. A smoothing capacitor $C_1$ may be electrically coupled in parallel across the load L.

Figure 7:
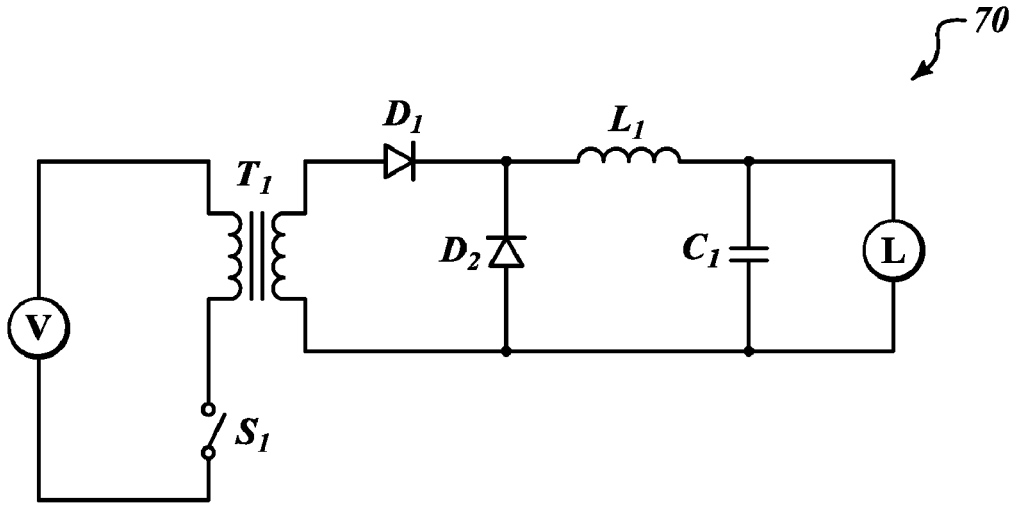
FIG. 7 is an electrical schematic diagram of a forward converter circuit employing a transformer having concentric first and second continuous single piece multi-turn helical windings, according to one illustrated embodiment.

FIG. 7 shows a single transistor forward converter 70 that employs a transformer $T_1$ having concentrically arranged continuous single piece multi-turn helical windings, according to another illustrated embodiment.

The single transistor forward converter 70 may electrically couple a power source V to a load L via the transformer $T_1$. A switch $S_1$ alternating electrically couples and decouples the power source V to a primary winding of the transformer $T_1$ to produce a changing current therethrough. The changing current passing through the primary winding of the transformer $T_1$ induces a current in a secondary winding of the transformer $T_1$.

The secondary winding is electrically coupled to the load L via a diode $D_1$, inductor $L_1$, and via a diode $D_2$ electrically coupled in parallel across the load L. A smoothing capacitor $C_1$ may also be electrically coupled in parallel across the load L.

Figure 8:
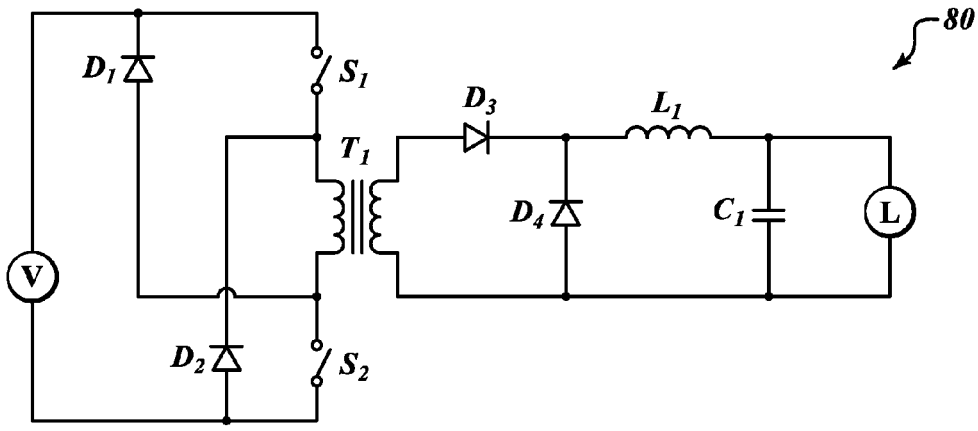
FIG. 8 is an electrical schematic diagram of a two transistor forward converter circuit employing a transformer having concentric first and second continuous single piece multi-turn helical windings, according to one illustrated embodiment.

FIG. 8 shows a two transistor forward converter 80 that employs a transformer $T_1$ having concentrically arranged continuous single piece multi-turn helical windings, according to another illustrated embodiment.

The two transistor forward converter 80 may electrically couple a power source V to a load L via the transformer $T_1$. A pair of switches $S_1$, $S_2$ (e.g., transistors such as FETs or IGBTs) concurrently electrically couple (i.e., closed or on) and decouple (i.e., open or off) the power source V to a primary winding of the transformer $T_1$. A pair of diodes $D_1$, $D_2$ are forward biased after the switches $S_1$, $S_2$, open, applying a negative voltage across the primary winding. The resulting changing current passing through the primary winding of the transformer $T_1$ induces a current in a secondary winding of the transformer $T_1$.

The secondary winding is electrically coupled to the load L via a diode $D_3$, inductor $L_1$, and via a diode $D_4$ electrically coupled in parallel across the load L. A smoothing capacitor $C_1$ may also be electrically coupled in parallel across the load L.

Figure 9:
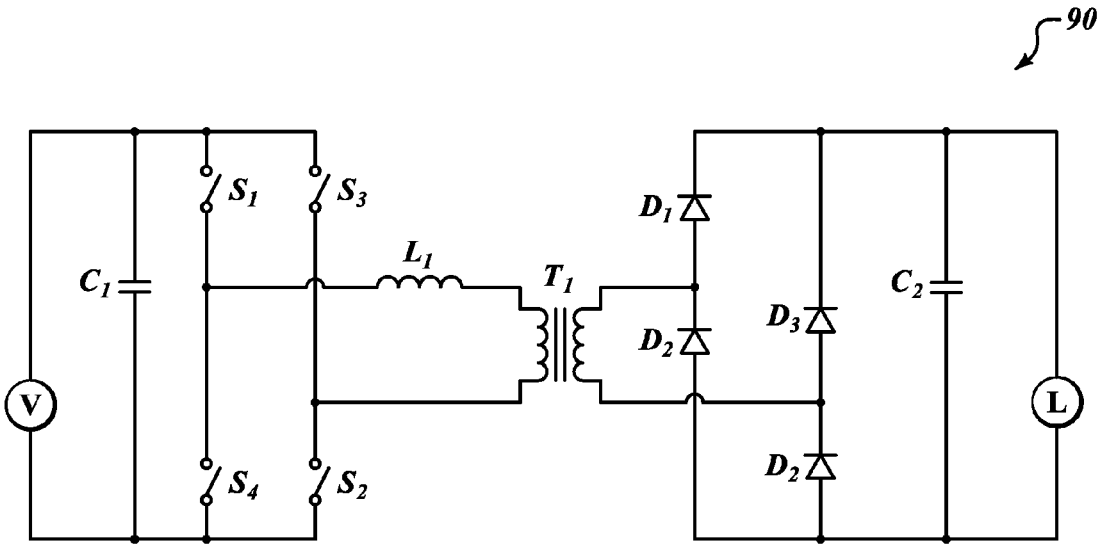
FIG. 9 is an electrical schematic diagram of an H-bridge converter circuit employing a transformer having concentric first and second continuous single piece multi-turn helical windings, according to one illustrated embodiment.

FIG. 9 shows an H-bridge converter 90 that employs a transformer $T_1$ having concentrically arranged continuous single piece multi-turn helical windings, according to another illustrated embodiment.

The H-bridge converter 90 may electrically couple a power source V to a load L via the transformer $T_1$. and an inductor $L_1$. A input capacitor $C_1$ may be electrically coupled in parallel across the power source. Two pairs of switches $S_1$, $S_2$ and $S_3$, $S_4$ alternating electrically couple and decouple the power source V to a primary winding of the transformer $T_1$ to produce a changing, alternating current therethrough. Thus, each switch $S_1$, $S_2$ of the first pair open and close together, and each switch $S_3$, $S_4$ open and close together, with the second pair of switches $S_3$, $S_4$, operating opposite the first pair of switches $S_1$, $S_2$. The changing current passing through the primary winding of the transformer $T_1$ induces a current in a secondary winding of the transformer $T_1$.

The secondary winding of the transformer T1 is electrically coupled to the load L via a set of diode $D_3$-$D_4$ arranged in a bridge to rectify the induced current. A smoothing capacitor $C_2$ may be electrically coupled in parallel across the load L.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art. The teachings provided herein of the various embodiments can be applied to other transformers, not necessarily the exemplary transformers generally described above. The teachings provided herein of the various embodiments can be applied to other circuits, including other converter circuits, not necessarily the exemplary converter circuits generally described above.

The various embodiments described above can be combined to provide further embodiments. To the extent that it is not inconsistent with the specific teachings and definitions herein, U.S. patent application Ser. No. 12/580,548, entitled "Transformer Having Interleaved Windings and Method of Manufacture of Same" filed concurrently herewith is incorporated herein by reference, in its entirety. Aspects of the embodiments can be modified, if necessary, to employ systems, circuits and concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A transformer, comprising: a first continuous single piece multi-turn helical winding having at least a first terminal and a second terminal; and a second continuous single piece multi-turn helical winding having at least a first terminal and a second terminal, a portion of the second continuous single piece multi-turn helical winding between the first and the second terminals received concentrically within an inner diameter of the first continuous single piece multi-turn helical winding, the portion of the second continuous single piece multi-turn helical winding spaced sufficiently closely to the first continuous single piece multi-turn helical winding to permit inductive coupling therebetween in response to a current running through at least one of the first or the second continuous single piece multi-turn helical windings, wherein at least one of the first or the second continuous single piece multi-turn helical winding consists of an electrical conductor and an electrically insulative sheath that electrically insulates the electrical conductor between first and the second terminals thereof from the other one of the first or the second continuous single piece multi-turn helical windings, wherein the electrical conductor of the at least one of the first or the second continuous single piece multi-turn helical windings has a rectangular cross-section taken perpendicular to a longitudinal axis of the first or the second continuous single piece multi-turn helical windings at a point along the longitudinal axis; and wherein the first terminal of the second continuous winding overlaps the upper most outer turn of the first continuous winding and the second terminal of the second continuous winding overlaps the bottom most outer turn of the first continuous winding and wherein the first and the second terminals of the second continuous winding point in the same direction.

2. The transformer of claim 1 wherein both of the first and the second continuous single piece multi-turn helical windings consist of an electrical conductor and an electrically insulative sheath that electrically insulates the electrical conductor between the first and the second terminals thereof.

3. The transformer of claim 1 wherein the first and the second continuous single piece multi-turn helical windings each have a smooth radius of curvature with no discontinuities between the first terminal and the second terminal as projected on an X-Y plane that is perpendicular to a respective longitudinal axis of the first and the second continuous single piece multi-turn helical windings.

4. The transformer of claim 1 wherein at least one of the first or the second continuous single piece multi-turn helical windings is cylindrical having a circular cross-section taken along a longitudinal axis of the first or the second continuous single piece multi-turn helical winding.

5. The transformer of claim 1 wherein the first continuous single piece multi-turn helical winding has only two terminals, each of the first and the second terminals thereof extending from a respective end of the first continuous single piece multi-turn helical winding and wherein the second continuous single piece multi-turn helical winding has only two terminals, each of the first and the second terminals thereof extending from a respective end of the second continuous single piece multi-turn helical winding.

6. The transformer of claim 1, further comprising:

at least a portion of a core received within an inner diameter of at least one of the first or the second continuous single piece multi-turn helical windings.

7. The transformer of claim 1, further comprising:

at least a portion of a ferrous core received within an inner diameter of at least one of the first or the second continuous single piece multi-turn helical windings.

8. The transformer of claim 1 wherein the first continuous single piece multi-turn helical winding has more turns than the second continuous single piece multi-turn helical winding.

9. The transformer of claim 1 wherein the first continuous single piece multi-turn helical winding has less turns than the second continuous single piece multi-turn helical winding.

10. A power converter, comprising: a first continuous single piece multi-turn helical winding having at least a first terminal and a second terminal;

a second continuous single piece multi-turn helical winding having at least a first terminal and a second terminal, a portion of the second continuous single piece multi-turn helical winding between the first and the second terminals received concentrically within an inner diameter of the first continuous single piece multi-turn helical winding, the portion of the second continuous single piece multi-turn helical winding spaced sufficiently closely to the first continuous single piece multi-turn helical winding to permit inductive coupling therebetween in response to a current running through at least one of the first or the second continuous single piece multi-turn helical windings, wherein at least one of the first or the second continuous single piece multi-turn helical winding consists of an electrical conductor and an electrically insulative sheath that electrically insulates the electrical conductor between first and the second terminals thereof from the other one of the first or the second continuous single piece multi-turn helical windings, the electrical conductor of the at least one of the first or the second continuous single piece multi-turn helical windings has a rectangular cross-section taken perpendicular to a longitudinal axis of the first or the second continuous single piece multi-turn helical windings at a point along the longitudinal axis; and wherein the first terminal of the second continuous winding overlaps the upper most outer turn of the first continuous winding and the second terminal of the second continuous winding overlaps the bottom most outer turn of the first continuous winding and wherein the first and the second terminals of the second continuous winding point in the same direction; and at least one switch operable to interrupt a flow of current through one of the first or the second continuous single piece multi-turn helical windings.

11. A transformer, comprising: a first continuous single piece multi-turn helical winding having at least a first terminal and a second terminal, each turn in the single piece multi-turn helical winding abuts at least one neighboring turn;

a second continuous single piece multi-turn helical winding having at least a first terminal and a second terminal, each turn in the single piece multi-turn helical winding abuts at least one neighboring turn; and a portion of the second continuous single piece multi-turn helical winding between the first and the second terminals received concentrically within an inner diameter of the first continuous single piece multi-turn helical winding, the portion of the second continuous single piece multi-turn helical winding spaced sufficiently closely to the first continuous single piece multi-turn helical winding to permit inductive coupling therebetween in response to a current running through at least one of the first or the second continuous single piece multi-turn helical windings, wherein at least one of the first or the second continuous single piece multi-turn helical winding comprises of an electrical conductor and an electrically insulative sheath immediately adjacent the helical winding that electrically insulates the electrical conductor between first and the second terminals thereof from the other one of the first or the second continuous single piece multi-turn helical windings, wherein the electrical conductor of the at least one of the first or the second continuous single piece multi-turn helical windings has a rectangular cross-section taken perpendicular to a longitudinal axis of the first or the second continuous single piece multi-turn helical windings at a point along the longitudinal axis; and wherein the first terminal of the second continuous winding overlaps the upper most outer turn of the first continuous winding and the second terminal of the second continuous winding overlaps the bottom most outer turn of the first continuous winding and wherein the first and the second terminals of the second continuous winding point in the same direction.

12. The transformer of claim 11, further comprising:

at least a portion of a core received within an inner diameter of at least one of the first or the second continuous single piece multi-turn helical windings.

13. The transformer of claim 11 wherein the first and the second continuous single piece multi-turn helical windings each have a smooth radius of curvature with no discontinuities between the first terminal and the second terminal as projected on an X-Y plane that is perpendicular to a respective longitudinal axis of the first and the second continuous single piece multi-turn helical windings.

14. The transformer of claim 11 wherein the first continuous single piece multi-turn helical winding has only two terminals, each of the first and the second terminals thereof extending from a respective end of the first continuous single piece multi-turn helical winding and wherein the second continuous single piece multi-turn helical winding has only two terminals, each of the first and the second terminals thereof extending from a respective end of the second continuous single piece multi-turn helical winding.

* * * * *